US010548454B2

(12) United States Patent
Berner et al.

(10) Patent No.: US 10,548,454 B2
(45) Date of Patent: Feb. 4, 2020

(54) DISHWASHER IN THE FORM OF A COMMERCIAL UTENSIL WASHER OR DISHWASHER WHICH IS DESIGNED AS A BATCH DISHWASHER

(71) Applicants: Dietrich Berner, Waldstetten (DE); Harald Disch, Elzach (DE); Martin Schrempp, Gengenbach (DE)

(72) Inventors: Dietrich Berner, Waldstetten (DE); Harald Disch, Elzach (DE); Martin Schrempp, Gengenbach (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 38 days.

(21) Appl. No.: 15/125,199

(22) PCT Filed: Mar. 11, 2015

(86) PCT No.: PCT/US2015/019852
§ 371 (c)(1),
(2) Date: Sep. 12, 2016

(87) PCT Pub. No.: WO2015/138545
PCT Pub. Date: Sep. 17, 2015

(65) Prior Publication Data

US 2017/0071440 A1 Mar. 16, 2017

(30) Foreign Application Priority Data

Mar. 13, 2014 (DE) ..... 10 2014 204 678
Feb. 20, 2015 (DE) ..... 10 2015 203 127
(Continued)

(51) Int. Cl.
*A47L 15/46* (2006.01)
*A47L 15/00* (2006.01)
*A47L 15/42* (2006.01)

(52) U.S. Cl.
CPC ..... *A47L 15/0081* (2013.01); *A47L 15/0026* (2013.01); *A47L 15/0028* (2013.01);
(Continued)

(58) Field of Classification Search
None
See application file for complete search history.

(56) References Cited

U.S. PATENT DOCUMENTS 2,947,311 A 8/1960 Fox
3,059,653 A * 10/1962 Ingolia ..... A47B 77/08 134/89
(Continued)

FOREIGN PATENT DOCUMENTS

CN 101366619 2/2009
CN 101998839 3/2011
(Continued)

OTHER PUBLICATIONS

PCT, International Search Report and Written Opinion of the International Searching Authority, International Application No. PCT/US2015/019852, 12 pages, dated May 22, 2015.
(Continued)

*Primary Examiner* — Katelyn B Whatley
(74) *Attorney, Agent, or Firm* — Thompson Hine LLP

(57) ABSTRACT

The invention relates to a dishwasher in the form of a commercial utensil washer or dishwasher which is designed as a batch dishwasher and is realized as a hood-type dishwasher, wherein the dishwasher has a treatment chamber with at least one wash system which is designed as a recirculation system, wherein the treatment chamber has a first treatment zone and at least one further, second treatment zone, wherein items of washware can be treated independently of one another and at least temporarily at the same time in the first and in the at least one second treatment zone.

18 Claims, 8 Drawing Sheets

(30) Foreign Application Priority Data

Feb. 20, 2015 (DE) ..... 10 2015 203 129
Feb. 20, 2015 (DE) ..... 10 2015 203 132
Feb. 20, 2015 (DE) ..... 10 2015 203 133

(52) U.S. Cl.
CPC ..... *A47L 15/0047* (2013.01); *A47L 15/0076* (2013.01); *A47L 15/0078* (2013.01); *A47L 15/4248* (2013.01); *A47L 15/46* (2013.01)

(56) References Cited

U.S. PATENT DOCUMENTS 3,288,154 A * 11/1966 Jacobs ..... A47L 15/0076 134/115 G
4,134,414 A * 1/1979 Jarvis ..... A47L 15/23 134/144
4,146,405 A * 3/1979 Timmer ..... A47L 15/23 134/115 R
5,934,298 A * 8/1999 Singh ..... A47L 15/0086 134/115 R
6,491,049 B1 12/2002 Tuller et al.
8,043,437 B1 * 10/2011 Delgado ..... A47L 15/0084 134/18
8,394,204 B2 3/2013 Buerkle
9,743,821 B2 8/2017 Baldwin
2004/0007256 A1 1/2004 Durazzani
2004/0244825 A1 12/2004 Ashton
2007/0124004 A1 * 5/2007 King ..... A47L 15/0084 700/40
2008/0289655 A1 11/2008 Buerkle
2011/0017235 A1 * 1/2011 Berner ..... A47L 15/0002 134/18
2012/0031432 A1 2/2012 Beaudet et al.
2012/0138092 A1 6/2012 Ashrafzadeh
2013/0056039 A1 * 3/2013 Hartz ..... A47L 15/0081 134/94.1
2013/0269736 A1 10/2013 Baldwin et al.
2016/0113478 A1 4/2016 Disch
2017/0071440 A1 3/2017 Berner
2018/0199792 A1 7/2018 Berner
2018/0206695 A1 7/2018 Disch

FOREIGN PATENT DOCUMENTS

DE 2304035 8/1974
DE 10004454 8/2001
DE 10058410 9/2002
DE 10058410 A1 9/2002
DE 10 2005 023 429 11/2006
DE 10 2005 023 429 A1 11/2006
DE 60030582 9/2007
DE 102006062071 7/2008
DE 102006062071 A1 7/2008
DE 20 2009 004 771 9/2010
DE 102011054150 6/2012
DE 102011084917 4/2013
DE 102013101661 10/2013
DE 102012207565 11/2013
DE 20 2014 010 365 5/2015
DE 10 2015 203 127 9/2015
EP 1790274 5/2007
FR 1480946 5/1967
FR 2640487 6/1990
GB 1248159 9/1971
JP 2000 166849 6/2000
JP 2002253470 9/2002
WO WO 01/93741 12/2001
WO 2011/128804 A1 10/2011
WO WO 2011/128804 10/2011
WO WO-2011128804 A1 * 10/2011 ..... A47L 15/0081
WO WO 2013090443 6/2013
WO 2014/186182 A2 11/2014
WO WO 2014/186182 11/2014
WO WO 2015/138545 9/2015

OTHER PUBLICATIONS

PCT, Witten Opinion of the International Preliminary Examining Authority, International Application No. PCT/US2015/019852, 7 pages, dated Jan. 22, 2016.
PCT, International Preliminary Report on Patentability, International Application No. PCT/US2015/019852, 9 pages, dated May 13, 2016.

* cited by examiner

DISHWASHER IN THE FORM OF A COMMERCIAL UTENSIL WASHER OR DISHWASHER WHICH IS DESIGNED AS A BATCH DISHWASHER

CROSS-REFERENCE TO RELATED APPLICATIONS

This application is a National Stage filing of International Application No. PCT/US2015/019852 filed Mar. 11, 2015, which claims priority of German Patent Application Nos. 10 2014 204 678.5 filed Mar. 13, 2014; 10 2015 203 132.2 filed Feb. 20, 2015; 10 2015 203 133.0 filed Feb. 20, 2015; 10 2015 203 129.2 filed Feb. 20, 2015; and 10 2015 203 127.6 filed Feb. 20, 2015, which are incorporated herein by reference in their entireties.

FIELD OF THE INVENTION

The invention relates to a dishwasher in the form of a commercial utensil washer or dishwasher which is designed as a batch dishwasher.

BACKGROUND

Batch dishwashers are dishwashers which can be manually loaded and unloaded. Batch dishwashers (also called "box-type warewashers") may be hood-type dishwashers ("hood-type warewashers") or front-loader dishwashers ("front-loader warewashers"). Front-loader dishwashers may be under-counter machines, top-counter machines or free-standing front-loader dishwashers.

A dishwasher which is in the form of a batch dishwasher usually has one treatment chamber for cleaning washware. The treatment chamber generally has arranged beneath it a wash tank in which liquid from the treatment chamber can flow back due to the force of gravity. The wash tank contains wash liquid which is usually water to which detergent may be added if required.

A dishwasher which is designed as a batch dishwasher usually also has a wash system comprising a wash pump, a line system which is connected to the wash pump, and comprising a large number of spray nozzles which are formed in at least one wash arm. The wash liquid contained in the wash tank can be conveyed from the wash pump to the wash nozzles via the line system and can be sprayed onto the washware to be cleaned through the wash nozzles in the treatment chamber. The sprayed wash liquid then flows back into the wash tank.

A dishwasher of this kind which is designed as a batch dishwasher is known, for example, from document DE 10 2005 023 429 A1.

The term "washware" used in the present document is intended to be understood to mean, in particular, crockery, glasses, cutlery, cooking utensils, baking utensils and serving trays.

The invention in particular relates to a dishwasher in the form of a commercial utensil washer or dishwasher which is designed as a batch dishwasher and is realized as a hood-type dishwasher, wherein the dishwasher has a treatment chamber with at least one wash system which is designed as a recirculation system.

Dishwashers of this type are used primarily (but not exclusively) in relatively small sculleries, for example in relatively small canteens, in particular school canteens, or in the catering sector. The use of dishwashers of this kind is characterized by said dishwashers being used in sculleries in which there is generally only a limited amount of floor space available.

A commercial dishwasher, in particular a hood-type dishwasher, which is designed as a batch dishwasher differs from a domestic dishwasher in particular in that a commercial dishwasher has to be designed in such a way that—depending on the treatment program selected—program run times of between one and five minutes can be realized, whereas domestic dishwashers generally have run times of up to 2.5 hours or more. On account of the short program duration required in commercial dishwashers, techniques employed in domestic dishwashers generally cannot be readily transferred to commercial dishwashers.

Commercial dishwashers which are in the form of batch dishwashers normally operate in two main process steps: a first step which includes washing with a wash liquid, and a second step which includes final rinsing with heated fresh water with the metered addition of a final rinse aid.

In order to be able to carry out these process steps, a commercial dishwasher, which is designed as a batch dishwasher, is generally equipped with two independent liquid systems. One liquid system is a wash water circuit which is responsible for washing the washware, with washing being carried out using recirculated water from the wash tank of the dishwasher. The other liquid system is a fresh water system which is responsible for final rinsing. Final rinsing is carried out using fresh water, preferably using fresh water from a water heater (boiler). The fresh water is likewise collected by the wash tank of the dishwasher after being sprayed.

The main objective of final rinsing is to remove wash liquor from the washware. In addition, the final rinse water which flows into the wash tank during the final rinse step serves to regenerate the wash water which is present in the wash tank.

Before fresh water is sprayed as final rinse liquid as a result of final rinsing and thus conducted into the wash tank of the dishwasher, a quantity of wash liquid which is equal to the quantity of fresh water is pumped out of the wash tank.

Commercial dishwashers which are designed as batch dishwashers are usually equipped with several programs. These programs differ mainly due to program run times of the wash process of different lengths. The operator has the option of selecting a short wash program for washware which is lightly soiled, or of selecting a correspondingly longer wash program for washware which is heavily soiled.

Commercial dishwashers, which are designed as batch dishwashers and are designed for loading washware into and unloading washware from the treatment chamber in batches, are, in particular, front-loader machines or hood-type machines. In the case of front-loader machines, the washware is placed in a rack and the rack which is loaded with washware is placed in the treatment chamber of the dishwasher through a front door and, after cleaning, is removed again through the front door. In the case of hood-type machines, the dish racks which are loaded with washware are pushed manually into the treatment chamber from an entry end and manually removed from the treatment chamber from an exit end when a wash program is complete. Front-loader machines and hood-type machines contain only a single treatment chamber for treating the washware. The front-loader machines may be under-counter machines or top-counter machines.

Virtually without exception, commercial dishwashers which are designed as batch dishwashers and are designed for loading washware into and unloading washware from the treatment chamber in batches are realized with entry and/or exit tables. The dirty washware is usually manually pre-cleared and manually pre-washed at the entry end of the dishwasher. Furthermore, the dirty washware is loaded into special dish racks here. The exit end is used for drying purposes and unloading the dish racks.

Particularly in the case of dishwashers which are realized as hood-type machines, the wash level is usually at the same height as the entry and exit tables. In this way, the dish racks which are to be cleaned can be easily and ergonomically pushed into the dishwasher from the entry table and, after cleaning is complete, pushed out of the dishwasher onto the exit table.

The term "dishwashing level" used in the present document is intended to be understood to mean the horizontal level at which the dish rack is situated. In the treatment chamber of a dishwasher, the dishwashing level is generally defined by a guide system, in particular guide rails, which accommodates a dish rack which is pushed into the treatment chamber from an entry table which is provided at the inlet end of the machine.

Commercial batch dishwashers, in particular those which are realized as hood-type dishwashers, are designed to clean large quantities of washware in as short a time as possible. For example, in state-of-the-art hood-type dishwashers, the duration of a preset standard program, which is usually used for washware, such as plates, trays, cups and glasses, with a normal level of soiling, lasts only approximately 60 to 80 seconds. This provides a theoretical capacity of up to 45 to 60 racks per hour.

However, depending on the washware and the degree of soiling of said washware, it may be necessary to select a treatment program with a longer duration in order to ensure a satisfactory cleaning result.

For example, in this connection, it is known from the prior art that commercial batch dishwashers have, for example, a special cutlery treatment program (intensive treatment program) for improving the cleaning result specifically of cutlery. An intensive treatment program of this kind lasts considerably longer than said 60 to 80 seconds of the standard treatment program, for example approximately 360 seconds. Therefore, it is clear that the capacity of the machine when the intensive treatment program is chosen is greatly reduced since the treatment chamber is occupied for considerably longer than would be the case with a standard treatment program.

In practice, this leads to special treatment programs which are usually already provided as alternatives to the standard treatment program as standard generally being chosen only rarely by the operator of the dishwasher, in spite of the improved washing performance, since the corresponding program duration is found to be too long, in particular at peak times, that is to say when there is an increased amount of washware arriving. Instead, the heavily soiled washware (in particular cutlery and GN containers) is often likewise treated using the standard treatment program and the poor washing performance is compensated for by additional manual operating steps, such as manual pre-washing of heavily soiled GN containers or separate pre-soaking of cutlery for example.

With heavily soiled washware, as is often the case with pots or pans for example, it is necessary in particular to correspondingly increase the cycle length in order to be able to achieve an acceptable cleaning result. In the case of hood-type dishwashers, the program run times are usually extended to up to 10 minutes in order to be able to clean heavily soiled washware, in particular pots and pans with burnt-on food residues, in a hygienically satisfactory manner.

Consequently, the dishwasher cannot be used to clean lightly soiled washware, such as plates, cups, cutlery or glasses for example, during these extended cycle times. In other words, the dishwasher is blocked for a relatively long period of time in order to clean heavily soiled washware, in particular pans and pots, this often leading to problems in relatively small sculleries since accruing dirty dishes cannot be cleaned or further processed during this period of time.

Therefore, in practice, particularly during peak times, the dishwasher is used only to clean lightly soiled washware, such as plates, cups and glasses for example, while the heavily soiled washware (in particular pots and pans) are manually cleaned in order to prevent the dishwasher being blocked for too long due to the relatively long cycle times required.

SUMMARY

Accordingly, the present invention is based on the object of further developing a commercial utensil washer or dishwasher, which is realized as a hood-type dishwasher and is generally known in principle from the prior art, in such a way that no bottlenecks occur during cleaning of the accruing washware even during peak times in sculleries. In particular, the aim is to indicate a solution with which the operating processes in sculleries can be simplified and optimized while at the same time saving resources (energy, water and chemicals).

A further object is to develop a commercial utensil washer or dishwasher, which is realized as a hood-type dishwasher, to the effect that the capacity of the machine can be increased, even when a treatment program which leads to a longer cycle run time than would be the case with a conventional standard treatment program is chosen. In particular, resources (energy, water and chemicals) should be saved at the same time in this case.

In order to achieve this object, the invention proposes, in particular, a dishwasher in the form of a commercial utensil washer or dishwasher which is designed as a batch dishwasher, wherein the dishwasher is realized as a hood-type dishwasher, and wherein the dishwasher has a treatment chamber with at least one wash system which is designed as a recirculation system. According to the invention, the treatment chamber has a first treatment zone and at least one further, second treatment zone, wherein items of washware can be treated independently of one another and at least temporarily at the same time in the first and in the at least one second treatment zone.

The term "can be treated independently of one another" used in the present document is intended to be understood to mean, in particular, the treatment zone-specific treatment of the washware in respect of action time, wash and/or rinse mechanics, and/or in respect of the selected treatment program. In other words, provision is made according to the invention to divide the treatment chamber into at least two zones, wherein at least some of the parameters which characterize the treatment of the washware (such as the action time, the wash/rinse mechanics, the temperature and/or composition of the wash liquid/final rinse liquid etc. for example) can be individually adjusted for each treatment zone.

In this connection, it is feasible for the two treatment zones to be realized physically, that is to say hermetically, separately from one another. This embodiment has the advantage, in particular, that different treatment programs can be selected for the corresponding treatment zones of the treatment chamber. In this connection, it is feasible, for example, for the washware to be treated in accordance with a standard treatment program in one treatment zone, while the washware is treated in accordance with an intensive treatment program in another treatment zone which is physically separated from the first treatment zone.

Secondly, the present invention is not restricted to batch dishwashers in which the at least two treatment zones of the treatment chamber are physically (hermetically) separated from one another with the aid of a partition. Rather, according to a further aspect of the present invention, provision is made for the two treatment zones to be designed within a common treatment chamber, and in particular for no hermetic separation to be provided between the at least two treatment zones.

Even in the case of embodiments of the kind in which the at least two treatment zones are not hermetically separated from one another, it goes without saying that it is likewise feasible for the washware to be treated in the different treatment zones for different action times. This is possible particularly when the same treatment program is chosen for the two treatment zones. In this connection, it is feasible, for example, for the washware to remain in one of the two treatment zones for only one program cycle, while the washware remains in the other treatment zone for more than one program cycle, it being possible for the action time to be correspondingly multiplied as a consequence.

According to a preferred realization of the solution according to the invention, provision is made for the at least two treatment zones to be arranged one above the other. In this connection, it is possible, in particular, for at least one of the at least two treatment zones, and preferably each of the at least two treatment zones, to be designed to accommodate a dish rack, in which the washware which is to be treated in the treatment zone in question is accommodated, in such a way that the lower region of the dish rack, which lower region supports the dish rack, lies at a predefined or predefinable horizontal wash level.

In a preferred realization of the dishwasher according to the invention, the first treatment zone can be closed by means of a hood which can be pivoted or moved vertically, and the at least one second treatment zone can be closed by means of a door which is designed separately from the hood. In this case, provision is made, in particular, for the first and at least one second treatment zone to be arranged one above the other.

It has proven advantageous in this case to realize the first treatment zone as a main treatment zone, and to realize the at least one second treatment zone as an auxiliary treatment zone. The dimensions and cleaning capacity of the main treatment zone (first treatment zone) and the dimensions and cleaning capacity of the auxiliary treatment zone (second treatment zone) are preferably matched to the types of washware (such as crockery, cutlery, glasses and pots for example) which are to be cleaned and usually accumulate in sculleries, the quantity of washware which is to be cleaned and usually accumulates per unit time, depending on the type of washware, and/or to the degree of soiling of the washware which accumulates per unit time, in such a way that all of the washware which accumulates can be cleaned as far as possible without a delay even during peak times during operation of the dishwasher.

In this connection, investigations in various sculleries have shown that it is advantageous when the first treatment zone (main treatment zone) has a loading volume which can be effectively used for cleaning washware and is 2 to 4 times greater than the loading volume of the at least one second treatment zone which can be effectively used. In this case, the first treatment zone is particularly suitable for cleaning lightly soiled washware which, in practice, accumulates substantially more frequently per unit time in respect of amount in comparison to heavily soiled washware.

In a preferred realization of the dishwasher, the loading volume of the first treatment zone which can be effectively used is between 60 and 180 liters, and preferably between 80 and 150 liters, and further preferably is approximately 120 liters. This has the result that the cleaning capacity of the first treatment zone, that is to say the quantity of units of washware which can be cleaned in the first treatment zone per unit time, corresponds to the cleaning capacity of a conventional hood-type dishwasher which is known from the prior art and has only a single treatment zone.

In respect of the loading volume of the at least one second treatment zone which can be effectively used, it has proven advantageous when this loading volume is between 25 and 75 liters, and preferably between 30 and 50 liters. This ensures that heavily soiled washware can also be promptly effectively cleaned even at peak times in sculleries.

In order for the dishwasher to fit into a customary work flow in a scullery in an optimum manner, it is preferred when the base area of the first treatment zone has dimensions which match the base area of a dish rack, and in particular has a base area of 600 mm×500 mm, 500 mm×500 mm or 400 mm×400 mm. Accordingly, the washware which is loaded into dish racks can be treated in batches in the first treatment zone.

In a preferred refinement of the dishwasher according to the invention, the first treatment zone can be closed by means of a hood which can be pivoted or moved vertically, wherein the hood is realized such that it can be pivoted or moved vertically upward by at least 300 mm, preferably by at least 400 mm. This ensures a sufficiently high insertion height, and therefore relatively large items of washware, such as trays for example, can also be introduced into the first treatment zone and removed from said first treatment zone without problems. In this connection, it is further advantageous when the first treatment zone has a height, which is effective for cleaning washware, of at least 400 mm.

In respect of the internal dimensions of the at least one second treatment zone, it is advantageous when said internal dimensions are matched to the dimensions of pans and/or pots which are usually used since this type of washware is generally the most soiled. According to one realization of the dishwasher according to the invention, the at least one second treatment zone has, to this end, a height, which is effective for cleaning washware, of at least 120 mm, and preferably of at least 150 mm.

In order that the dishwasher according to the invention can also be used without problems in relatively small sculleries, the dishwasher has, in the closed state of the treatment zones, a width of between 500 mm and 800 mm, and preferably of between 600 mm and 800 mm, a depth of between 700 mm and 900 mm, and preferably of between 750 mm and 850 mm, and a height of between 1350 mm and 1600 mm, and preferably of between 1400 mm and 1550 mm.

According to a further aspect of the present invention, the dishwasher has a wash system, which is designed as a recirculation system, for spraying wash liquid in the treatment chamber as required, and has at least one final rinse system for spraying final rinse liquid in the treatment chamber as required. Furthermore, a control device is provided for actuating the at least one wash system and/or the at least one final rinse system. In this case, the control device is preferably designed to actuate the at least one wash system in such a way that the wash cycle of each treatment cycle in the first treatment zone is interrupted, while the wash cycle of a single treatment cycle in the at least one second treatment zone is intermittent. In this way, it is also possible to adjust the action times of the wash liquid in the individual treatment zones in each case to any desired values only using a single wash pump and without the use of a valve controller.

In a development of the last-mentioned embodiment, provision is made in this connection for the control device to also be designed to actuate the at least one wash system in such a way that wash liquid is always sprayed at the same time in the first and in the at least one second treatment zone.

In respect of the at least one final rinse system, provision is preferably made for the control device to be designed to actuate the at least one final rinse system in such a way that, in the at least one second treatment zone, a final rinse cycle always takes place simultaneously or at least so as to overlap with a final rinse cycle in the first treatment zone. Therefore, the risk of the washware being re-soiled is minimized, this applying in particular to embodiments in which the treatment zones are not hermetically separated.

In order for the dishwasher to operate as efficiently as possible in respect of time, provision is made in a preferred realization of the dishwasher for the treatment cycles in the first and in the at least one second treatment zone to be matched to one another with respect to time. To this end, it is feasible for the at least one wash system to be actuated by the control device in such a way that the duration of a wash cycle of a single treatment cycle in the at least one second treatment zone matches the total duration of the wash cycles of a large number of treatment cycles in the first treatment zone.

The term "treatment cycle" used in the present document is intended to be understood to mean the cycle to which the washware in question is subjected in the corresponding treatment zone of the dishwasher before the washware can be removed from the treatment zone again in the cleaned state. Therefore, a treatment cycle is usually made up of a wash cycle and a final rinse cycle which takes place following said wash cycle. Wash liquid is sprayed onto the washware during a wash cycle, while final rinse liquid is sprayed onto the washware during a final rinse cycle.

As an alternative or in addition to the last-mentioned embodiment, it is feasible to actuate the at least one wash system by means of the control device in such a way that the duration of a wash cycle of a single treatment cycle in the at least one second treatment zone is an integer multiple of the duration of one wash cycle in the first treatment zone.

In a preferred development of the dishwasher according to the invention, the control device is also designed to actuate the at least one wash system and/or the at least one final rinse system in such a way that a wash cycle in the at least one second treatment zone is interrupted automatically, preferably selectively automatically, when at least one of the following conditions is met:

- a final rinse cycle is taking place in the first treatment zone; and/or
- the first treatment zone is open or is not closed; and/or
- the second treatment zone is open or is not closed.

In this way, the respective final rinse cycle of the individual treatment zones can be matched in an optimum manner, this saving resources, in particular fresh water and energy.

In order to be able to treat the washware in the treatment zones as efficiently as possible, provision is made in a development of the invention for the treatment parameters for the treatment zones to be selected in as individual a manner as possible and such that they are matched to the washware which is to be cleaned.

In this connection, it is feasible for the at least one wash system to be actuated in such a way that, during a wash cycle:

- the temperature of the wash liquid which is sprayed in the first treatment zone is different from the temperature of the wash liquid which is sprayed in the at least one second treatment zone; and/or
- the nozzle pressure of the wash liquid which is sprayed in the first treatment zone is different from the nozzle pressure of the wash liquid which is sprayed in the at least one second treatment zone; and/or
- the quantity of wash liquid which is sprayed in the first treatment zone per unit time is different from the quantity of wash liquid which is sprayed in the at least one second treatment zone per unit time; and/or
- the concentration of detergent in the wash liquid which is sprayed in the first treatment zone is different from the concentration of detergent in the wash liquid which is sprayed in the at least one second treatment zone.

As an alternative or in addition to this, it is feasible for the at least one final rinse system to be actuated by means of the control device in such a way that, during a final rinse cycle:

- the temperature of the final rinse liquid which is sprayed in the first treatment zone is different from the temperature of the final rinse liquid which is sprayed in the at least one second treatment zone; and/or
- the nozzle pressure of the final rinse liquid which is sprayed in the first treatment zone is different from the nozzle pressure of the final rinse liquid which is sprayed in the at least one second treatment zone; and/or
- the quantity of final rinse liquid which is sprayed in the first treatment zone per unit time is different from the quantity of final rinse liquid which is sprayed in the at least one second treatment zone per unit time; and/or
- the concentration of final rinse aid in the final rinse liquid which is sprayed in the first treatment zone is different from the concentration of final rinse aid in the final rinse liquid which is sprayed in the at least one second treatment zone.

The invention is not only directed at an, in particular, hood-type dishwasher in which at least two treatment zones are provided in the treatment chamber of the dishwasher, but also to a corresponding method for operating a dishwasher of this kind.

According to the invention, the method comprises the following method steps:

- wash liquid is sprayed at the same time in the first treatment zone and in the at least one second treatment zone until the wash cycle in the first treatment zone is complete;
- after the wash cycle in the first treatment zone is complete, the wash cycle of the at least one second treatment zone is interrupted and final rinse liquid is sprayed in the first treatment zone; and
- spraying of wash liquid in the at least one second treatment zone is resumed only when a further wash cycle is started in the first treatment zone.

In order to carry out the method according to the invention, the dishwasher has—according to a further aspect of the present invention—a control device for actuating the at least one wash system of the dishwasher in accordance with a predefined program sequence, wherein at least one predefined program sequence for the first treatment zone and/or the at least one second treatment zone is stored in the control device. In particular, a large number of predefined program sequences for the first treatment zone and/or the at least one second treatment zone are stored in the control device in order to allow the operator to choose treatment parameters which are matched as far as possible.

In order to reduce the effort for operator control when choosing a program, provision is made in a preferred development of the last-mentioned embodiments for at least one program sequence group containing a defined program sequence for the first treatment zone and a defined program sequence for the at least one second treatment zone to be stored in the control device.

In this connection, it is feasible, in particular, for the operator to selectively choose a program sequence from the large number of predefined program sequences for the first treatment zone and, independently of this, a program sequence from the large number of predefined program sequences for the at least one second treatment zone, or a predefined program sequence group.

The program sequences of the program sequence group are preferably chosen depending on at least one of the factors listed below:

- a quantity of washware which preferably accumulates per unit time in a standard situation; and/or
- the different types of washware which preferably accumulate per unit time in a standard situation; and/or
- a degree of soiling of the washware which preferably occurs in a standard situation.

In a preferred realization of the last-mentioned embodiments, provision is made for the program sequence group to have a program sequence for the first treatment zone, the duration of a wash cycle of the first treatment zone being 40 to 70 seconds (short program), 70 to 120 seconds (standard program) or 2 to 5 minutes (intensive program) in accordance with said program sequence. In respect of the program sequence for the at least one second treatment zone, provision is made in this case for the duration of a wash cycle in the at least one second treatment zone to be identical to the duration of a wash cycle in the first treatment zone in accordance with said program sequence.

As an alternative or in addition to this, it is feasible for the program sequence group to have a program sequence for the at least one second treatment zone, the duration of a wash cycle in the at least one second treatment zone being 40 to 70 seconds (short program), 70 to 120 seconds (standard program) or 4 to 10 minutes (intensive program) in accordance with said program sequence.

According to a further aspect of the present invention, provision is made for the dishwasher to have at least one user interface with at least one input area, in particular which can be manually or optically operated, for manually choosing at least one treatment program for the first and/or at least one second treatment zone.

An "input area which can be manually operated" is intended to be understood to mean, in particular, a keypad or the like, while an "input area which can be optically operated" is an input area which can be actuated by means of radio, IR, WLAN or a similar wireless communication connection.

According to a preferred realization, provision is made in this case for a common user interface to be provided for the first and at least one second treatment zone. This common user interface is preferably arranged in the upper region of the hood which can be pivoted or moved vertically and by means of which the first treatment zone can be closed. This ensures that the operator of the machine can manually operate the input area only when the first treatment zone is closed.

As an alternative to this, it goes without saying, however, that it is also feasible for a user interface to be provided in each case for the first and at least one second treatment zone.

In a preferred realization of the invention, provision is made for the at least one user interface to be designed to provide, preferably optically and/or acoustically, information relating to a system state of the dishwasher.

As an alternative or in addition, it is feasible for the at least one user interface to have at least one input area, in particular keypad, in particular which can be optically or manually operated, for manually intervening in a treatment cycle of the first treatment zone and/or in a treatment cycle of the at least one second treatment zone.

In this connection, it is also feasible for the at least one user interface to have a first input area, in particular keypad, which can be manually operated, for starting and/or completing a treatment cycle in the first and/or at least one second treatment zone, and has a second input area, in particular which can be manually or optically operated and is realized separately from the first input area, for retrieving information relating to a system state of the dishwasher and/or for manually intervening in a treatment cycle of the first and/or at least one second treatment zone and/or for calling up and/or choosing program parameters for the first and/or at least one second treatment zone.

BRIEF DESCRIPTION OF THE DRAWINGS

The invention will be described in greater detail below with reference to the exemplary embodiments which are illustrated in the drawings.

In the drawings.

DETAILED DESCRIPTION

The invention relates to commercial dishwashers, in particular dishwashers or utensil washers, in the form of a batch dishwasher. In particular, the present invention relates to batch dishwashers which are realized as hood-type dishwashers.

A commercial dishwasher 1, which is realized as a batch dishwasher, usually has a program control device (also designated "control device 100" in the present document) for controlling at least one cleaning program, and has a treatment chamber 2, which can be closed by at least one door 9 and/or at least one hood 8, in a machine housing for accommodating washware, such as crockery, cutlery, pots, pans, trays and glasses for example, which is to be cleaned.

Figure 2:
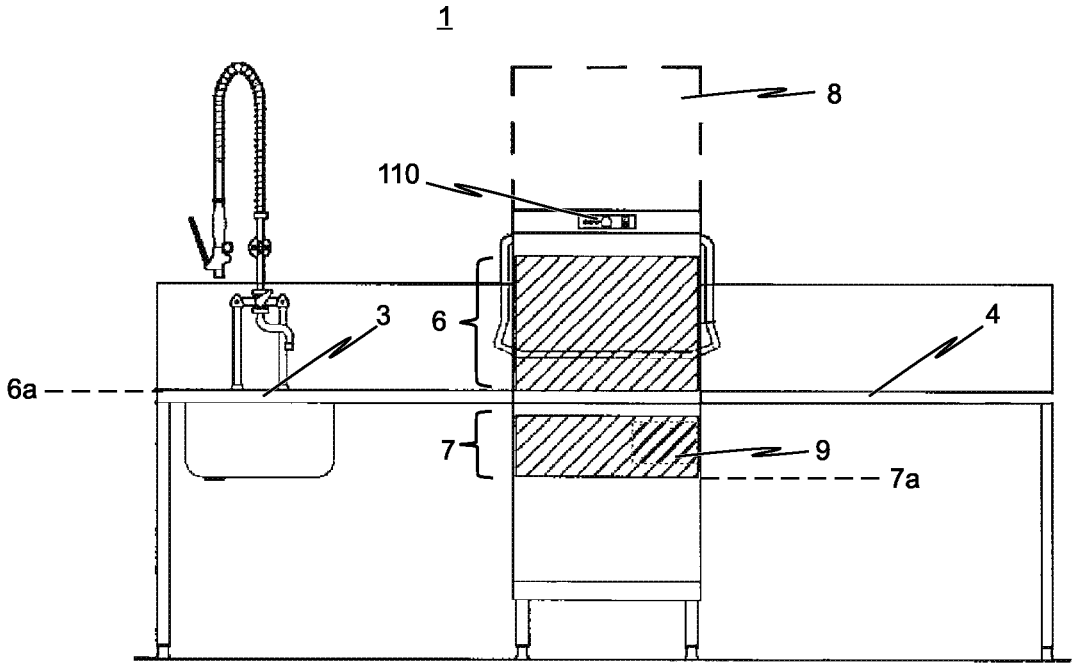
FIG. 2 schematically shows a batch dishwasher, which is realized as a hood-type dishwasher, according to a further embodiment of the invention.
Figure 3:
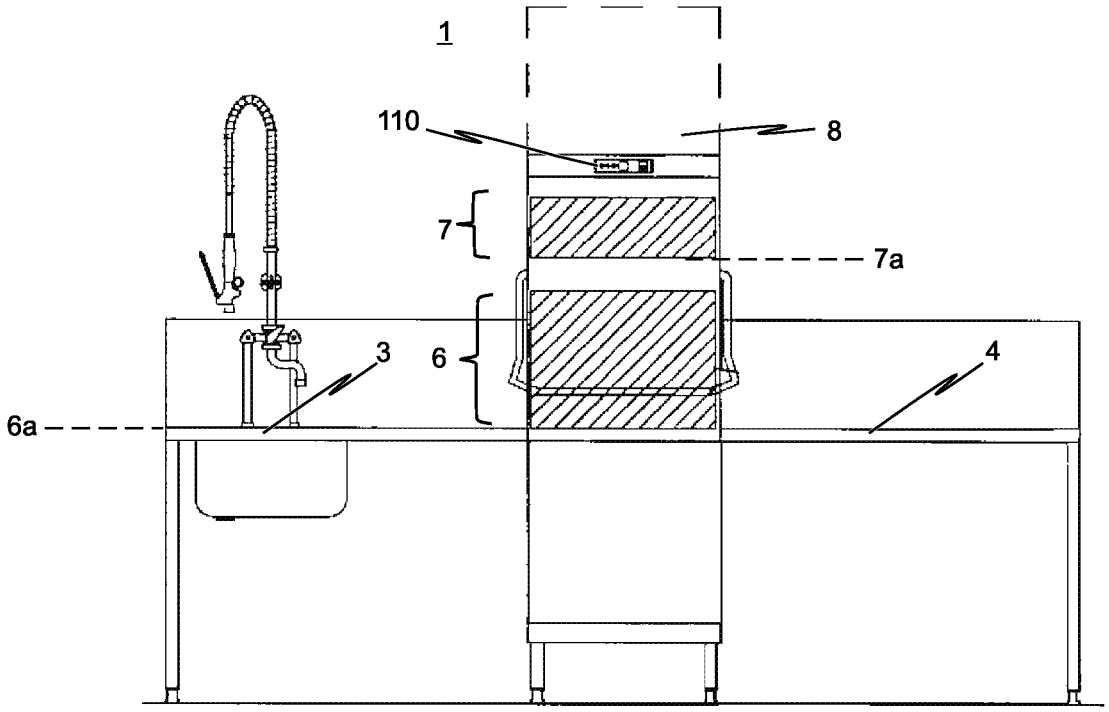
FIG. 3 schematically shows a batch dishwasher, which is realized as a hood-type dishwasher, according to a further embodiment of the invention.

As can be seen in the illustrations in FIGS. 2 and 3 in particular, it is advantageous from an ergonomical perspective for a batch dishwasher, which is realized as a hood-type dishwasher 1, to be equipped with a respective table (entry table 3, exit table 4) at its entry end and exit end. The racks 5 which are loaded with dirty washware can therefore be pushed into the dishwasher 1 at the entry table 3. After the washware is treated in the treatment chamber 2 of the dishwasher 1, the rack 5 containing the now cleaned washware is moved out of the machine 1 onto the exit table 4.

The action time, that is to say the time during which cleaning liquid or wash liquid wets the washware within the treatment chamber 2, depends, in particular, on the duration of the wash phase, which duration is defined by means of the treatment program. For normally soiled washware, such as plates, trays, cups and glasses, a cleaning cycle comprising a wash phase and a subsequent final rinse phase generally requires between 50 and 100 seconds. However, longer treatment of the washware may be necessary, in particular when said washware exhibits a high level of soiling, or when dirt is burnt onto the washware. Extension of the total treatment time to up to 400 seconds is often required in this case. Owing to the extended action time, the washware which is to be cleaned is subjected to intensive treatment, so that heavily soiled washware can also be effectively cleaned.

In order to ensure that the cleaning capacity of the dishwasher 1, that is to say the units of washware/washware racks 5 which can theoretically be processed by the machine 1 per unit time, is not negatively influenced in spite of an intensive treatment, provision is made according to the invention for the treatment chamber 2 of the dishwasher 1, which is designed as a batch dishwasher, to be divided into at least two treatment zones 6, 7, wherein the at least two treatment zones 6, 7 are realized such that the washware can be treated in the individual treatment zones 6, 7 independently of one another.

Even though the exemplary embodiments of the dishwasher 1 according to the invention which are illustrated in the drawings are each realized with exactly two treatment zones 6, 7, this should not be regarded as being restrictive. Rather, it goes without saying that it is also feasible for the treatment chamber 2 of the dishwasher 1 according to the invention to be divided into more than two zones.

Figure 1A:
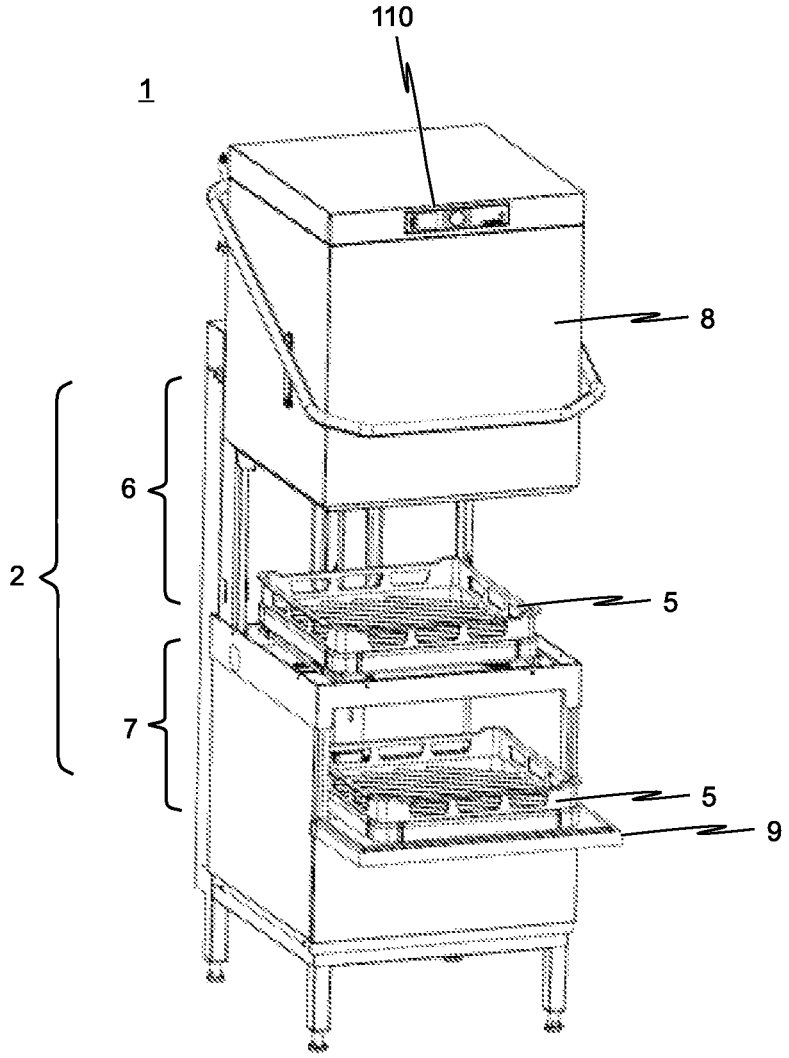
FIG. 1*a* shows a perspective view of a batch dishwasher, which is realized as a hood-type dishwasher, according to one embodiment of the present invention.
Figure 1B:
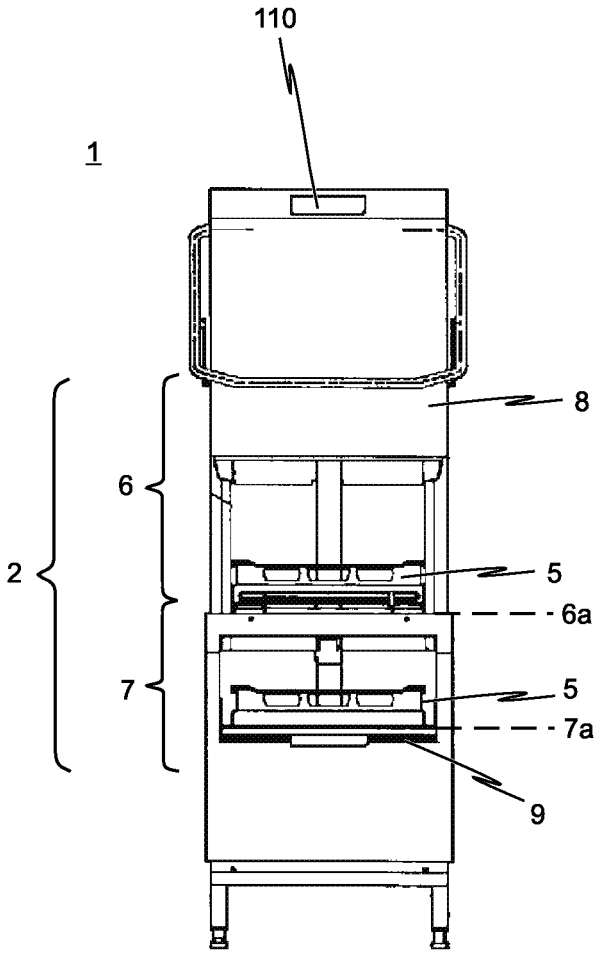
FIG. 1*b* shows a front view of the embodiment which is shown in FIG. 1*a;*

As illustrated in FIGS. 1*a* and 1*b* for example, one exemplary embodiment of the present invention relates to a hood-type dishwasher 1 which is distinguished, in particular, in that, in addition to the usually provided (main) treatment zone 6, a further treatment zone 7 which is arranged beneath said treatment zone 6 is provided. The upper main treatment zone 6, which is also designated "first treatment zone" in the present document, is designed to accommodate a dish rack 5 which may be loaded with the washware which is to be treated.

To this end, the base area of the first treatment zone or main treatment zone 6 has dimensions which match the base area of a dish rack 5, and in particular has a base area of 600 mm×500 mm, 500 mm×500 mm or 400 mm×400 mm.

Furthermore, the main treatment zone 6 is designed such that the dish rack 5 can be pushed directly into the treatment zones 6 of the hood-type dishwasher 1 from an entry table 3 (not illustrated in FIGS. 1*a* and 1*b*). In other words, the wash level 6*a* of the main treatment zone 6 is aligned with the table height of the entry table 3 in the horizontal direction.

In the dishwasher 1 which is shown in FIG. 1*b*, the height of the horizontal wash level 6*a* of the first treatment zone 6 can, in particular, be variably adjusted and is preferably 800 mm to 900 mm, and preferably 830 mm to 890 mm. The height of the horizontal wash level 6*a* of the first treatment zone 6 is adjusted, for example, by means of vertically adjustable feet of the machine.

An exit table 4 is also preferably provided, wherein the table height of the exit table 4 is likewise horizontally aligned with the wash level 6*a* of the main treatment zone 6, so that the dish rack 5 can be pushed directly onto the exit table 4 after treatment in the main treatment zone 6.

As already indicated, a further treatment zone 7 is realized beneath the main treatment zone 6. This further treatment zone 7, which is also designated "second treatment zone" or "auxiliary treatment zone" in the present document, serves, in particular, for cleaning washware which requires a longer action time in comparison to the washware which is to be cleaned in the first treatment zone 6.

In the exemplary embodiment which is illustrated in FIGS. 1*a* and 1*b*, the second treatment zone 7 is likewise designed to accommodate a dish rack 5, wherein the washware which is to be treated in the further treatment zone 7 is accommodated in the dish rack 5.

Specifically, the dimensions and cleaning capacity of the main treatment zone (first treatment zone 6) and the dimensions and cleaning capacity of the auxiliary treatment zone (second treatment zone 7) are preferably matched to the types of washware (such as crockery, cutlery, glasses and pots for example) which are to be cleaned and usually accumulate in sculleries, the quantity of washware which is to be cleaned and usually accumulates per unit time, depending on the type of washware, and/or to the degree of soiling of the washware which accumulates per unit time, in such a way that all of the washware which accumulates can be cleaned as far as possible without a delay even during peak times during operation of the dishwasher 1.

Therefore, in the embodiment of the dishwasher 1 according to the invention which is shown in FIG. 1*b*, provision is made for the first treatment zone 6 to have a loading volume which can be effectively used for cleaning washware and is 2 to 4 times greater than the loading volume of the second treatment zone 7 which can be effectively used. Specifically, the loading volume of the first treatment zone 6 which can be effectively used is between 60 and 180 liters, and preferably between 80 and 150 liters, and further preferably is approximately 120 liters, while the loading volume of the second treatment zone 7 which can be effectively used is between 25 and 75 liters, and preferably between 30 and 50 liters. This ensures that heavily soiled washware can also be promptly effectively cleaned even at peak times in sculleries.

As illustrated, in the exemplary embodiment of the invention which is schematically illustrated in FIGS. 1*a* and 1*b*, provision is made for washware to be loaded into and unloaded from the two treatment zones 6, 7 independently of one another. Specifically, washware can be loaded into or unloaded from the first treatment zone 6 via an opening which can be closed by a hood 8 which can move in the vertical direction. The movement travel of the hood 8 is at least 300 mm, preferably at least 400 mm, while the first treatment zone 6 has a height, which is effective for cleaning washware, of at least 400 mm.

Secondly, the second treatment zone 7 has a height, which is effective for cleaning washware, of at least 120 mm, and preferably of at least 150 mm, and therefore cutlery which is accommodated in cutlery racks can also be cleaned in this treatment zone 7.

In addition to this, the second treatment zone 7 has a dedicated opening which can be closed and via which washware can be loaded into or unloaded from said treatment zone 7.

In the exemplary embodiment which is illustrated in FIGS. 1*a* and 1*b*, provision is made, in particular, for the second treatment zone 7 to have a dedicated opening which can be closed by means of a door 9 that can be pivoted about a horizontal pivot axis and via which opening washware can be loaded into and unloaded from the second treatment zone 7.

In this case, it is advantageous, in particular, for the door 9 which can be pivoted about a horizontal pivot axis to be designed in such a way that said door, when it is in its open state, is horizontally aligned with the wash level 7*a* of the further treatment zone 7. In this way, the door 9, in its open state, serves simultaneously as a loading and unloading aid for inserting and, respectively, removing the washware into/from the dish rack 5.

Like the height of the horizontal wash level 6*a* of the first treatment zone 6, the height of the horizontal wash level 7*a* of the second treatment zone 7 can be variably adjusted, and is preferably 350 mm to 600 mm, and further preferably 500 mm to 600 mm (measured from the floor of the room in which it is installed).

FIG. 2 shows the exemplary embodiment of the dishwasher 1 according to the invention in line with FIGS. 1*a* and 1*b* in a configuration in which the dishwasher 1 is equipped with entry and exit tables 3, 4. Specifically, the dirty washware is usually manually pre-cleared and manually pre-washed at the entry end of the dishwasher 1. Furthermore, the dirty washware can be loaded into special dish racks 5 here.

The exit end is used for drying purposes and unloading the dish racks. As illustrated in FIG. 2, the wash level 6*a* of the main treatment zone 6 is at the same height as the entry and exit tables 3, 4. In this way, the dish racks 5 which are to be cleaned can be easily and ergonomically pushed into the main treatment zone 6 of the hood-type dishwasher 1 from the entry table 3 and, after cleaning is complete, pushed out of the dishwasher 1 onto the exit table 4.

As can be seen, in particular, in the schematic illustration in FIG. 3, the present invention is not restricted to the additional treatment zone 7 being arranged beneath the main treatment zone 6. Rather, it goes without saying that it is also feasible for the additional treatment zone 7 to be arranged next to the main treatment zone 6 or above the main treatment zone 6.

In respect of the embodiments of the dishwasher 1 according to the invention which are shown in FIGS. 1 to 3, it should be noted that said dishwasher has, in the closed state of the treatment zones 6, 7, a width of between 500 mm and 800 mm, and preferably of between 600 mm and 800 mm, a depth of between 700 mm and 900 mm, and preferably of between 750 mm and 850 mm, and a height of between 1350 mm and 1600 mm, and preferably of between 1400 mm and 1550 mm. In other words, the external dimensions of the dishwasher 1 according to the invention are comparable with those of a conventional machine of the same type which, however, has only a single treatment zone, wherein the machine capacity is increased, along with a relatively reduced consumption of resources, using the dishwasher according to the invention.

In order to clean, for example, the washware which accumulates in the case of a total of 150 meals, a conventional dishwasher, which however has only a single treatment zone, requires a total of 67 minutes and a fresh water consumption of 100 liters and an energy consumption of 2.9 kWh (with a standard treatment program).

Using the dishwasher 1 according to the invention however, the treatment duration can be reduced to less than 50 minutes, specifically with a fresh water consumption of 72.5 liters and an energy consumption of 2.1 kWh.

The manner of operation of different wash/final rinse systems which can be used, for example, in a dishwasher 1 according to the present invention which is designed as a batch dishwasher is described below with reference to the illustrations in FIGS. 4 to 6.

Although it is feasible, in principle, to equip the dishwasher 1 according to the present invention with several wash tanks, wherein each wash tank is associated with a treatment zone 6, 7, provision is made in the preferred exemplary embodiments of the solution according to the invention which are illustrated in the drawings for the dishwasher 1 to in each case have only a single wash tank 12 which is associated with the (single) treatment chamber 2 and therefore with the individual treatment zones 6, 7 of the (single) treatment chamber 2 jointly.

The wash tank 12 preferably has a capacity of 20 to 40 liters, preferably 25 to 35 liters. This capacity is firstly sufficient for the simultaneous final rinse operation in the two treatment zones 6, 7. Secondly, the tank 12 is selected to be so small that, as before, it can be accommodated in the reduced—in comparison to a conventional machine which however has only a single treatment zone—installation space in the machine housing.

Figure 4:
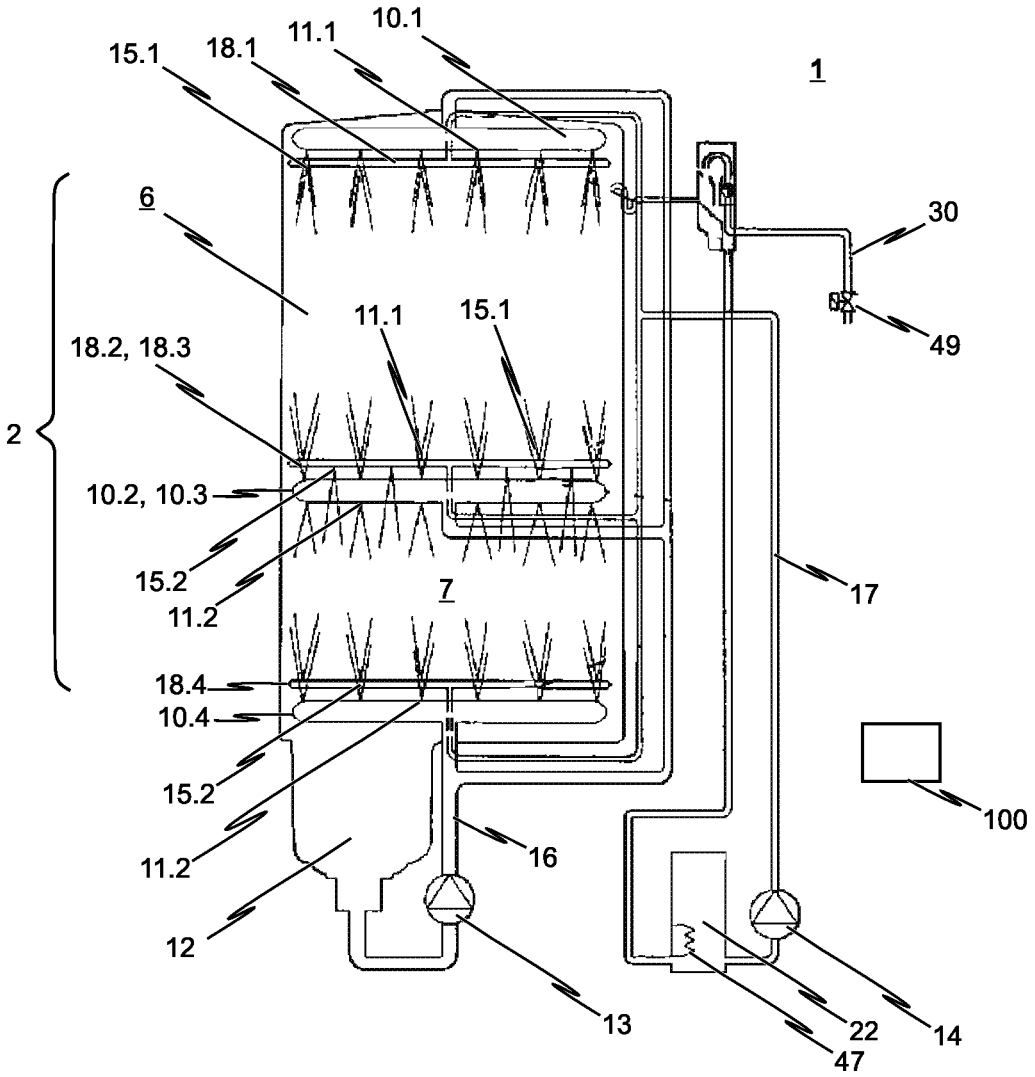
FIG. 4 schematically shows a hydraulics diagram of a wash system of a dishwasher, which is designed as a batch dishwasher, according to one embodiment of the present invention.
Figure 5:
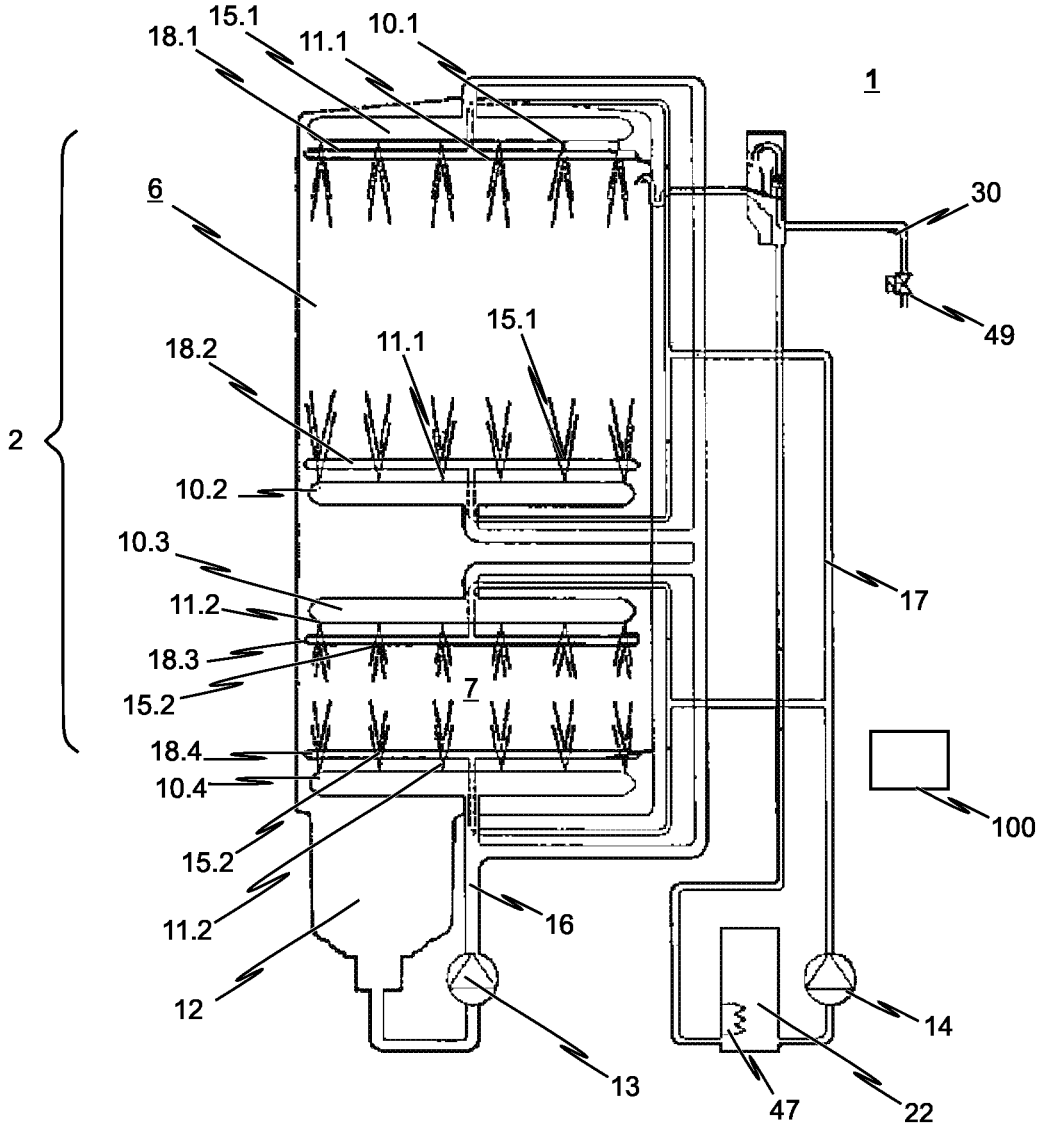
FIG. 5 schematically shows a hydraulics diagram of a wash system of a dishwasher, which is designed as a batch dishwasher, according to a further embodiment of the present invention.
Figure 6:
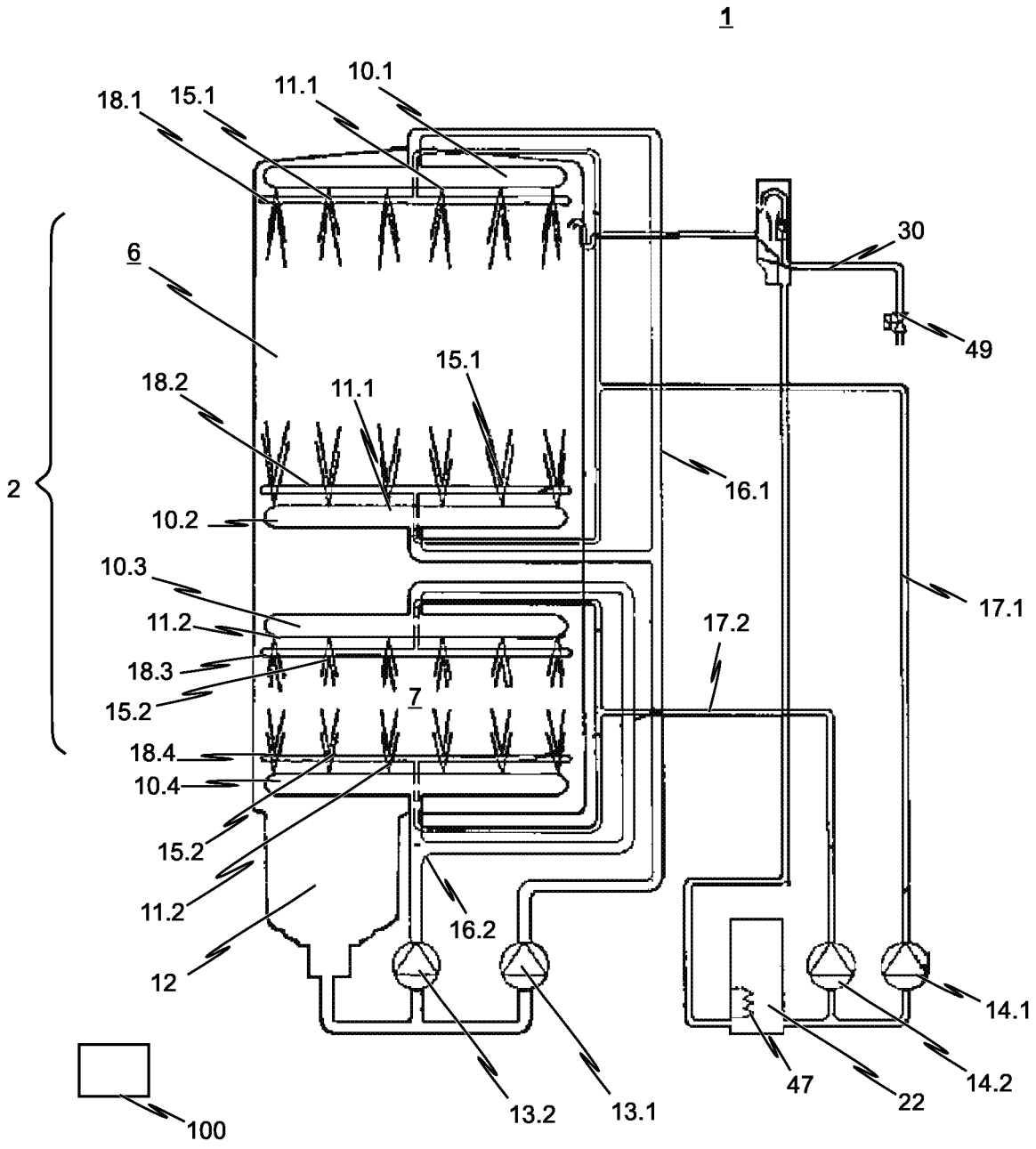
FIG. 6 schematically shows a hydraulics diagram of a wash system of a dishwasher, which is designed as a batch dishwasher, according to a further embodiment of the present invention.

As illustrated in the hydraulics diagrams according to FIGS. 4 to 6, the (single) wash tank 12 is located beneath the treatment chamber 2 of the machine 1 and serves to receive liquid which is sprayed in the respective treatment zones 6, 7 of the treatment chamber 2. As already indicated, provision is made in the embodiments illustrated in the drawings for the treatment chamber 2 of the dishwasher 1 to be divided into a total of two treatment zones 6, 7, specifically into a main treatment zone 6 and an additional treatment zone 7. A common wash system is associated with the treatment zones 6, 7 which are integrated within the (single) treatment chamber 2.

In the hydraulics diagram which is illustrated in FIG. 4, the wash system has a (common) wash pump 13 with which wash liquid can be conveyed from the wash tank 12, through a wash liquid line system, to corresponding wash nozzles 11.1, 11.2.

In the embodiment which is schematically illustrated in FIG. 4, the wash nozzles 11.1, 11.2 are integrated into corresponding wash arms 10.1, 10.2, 10.3, 10.4. In this case, provision is made for a first nozzle arrangement comprising an upper wash arm 10.1 and a lower wash arm 10.2 to be associated with the upper (main) treatment zone 6. A further nozzle arrangement, which likewise has an upper wash arm 10.3 and a lower wash arm 10.4, is associated with the lower (additional) treatment zone 7.

In the hydraulics diagram which is shown in FIG. 4, the lower wash arm 10.2 of the main treatment zone 6 and the upper wash arm 10.3 of the additional treatment zone 7 are realized as a common wash arm. In other words, a single wash arm 10.2, 10.3 which has a double function is used in this exemplary embodiment: said common wash arm serves as a lower wash arm of the (upper) main treatment zone 6 and, at the same time, as an upper wash arm of the (lower) additional treatment zone 7. To this end, the common wash arm has wash nozzles 11.1 which are oriented in the direction of the (upper) main treatment zone 6, and wash nozzles 11.2 which are oriented in the direction of the (lower) additional treatment zone 7.

It goes without saying that the present invention is not restricted to this aspect. As can be seen in the hydraulics diagram according to FIG. 5, it is also feasible for a common wash arm to not be used, and therefore for separate wash arms 10.1-10.4 to be associated with each individual treatment zone 6, 7.

The wash nozzles 11.1, 11.2 which are integrated into the corresponding wash arms 10.1-10.4 are each directed toward the correspondingly associated treatment zone 6, 7 in the treatment chamber 2 and serve for spraying wash liquid, which is conveyed by the common wash pump 13, onto the washware which is to be cleaned and is arranged in the treatment zones 6, 7 in question.

The sprayed wash liquid falls back into the wash tank 12 due to the force of gravity. As a result, the wash tank 12, the wash pump 13, the wash liquid system 16 and the wash nozzles 11 form a wash liquid circuit together with the treatment zones 6, 7 of the treatment chamber 2. The wash liquid line system 16 connects the delivery end of the wash pump 13 to the wash nozzles 11.1, 11.2.

Also provided is a final rinse system for conveying final rinse liquid through a final rinse line system 17 to final rinse nozzles 15.1, 15.2, which are directed toward the region of the washware which is to be cleaned in the treatment chamber 2, by means of a final rinse pump 14. The sprayed final rinse liquid falls into the wash tank 12 from the treatment chamber 2 due to the force of gravity. The final rinse liquid system 17 connects the delivery end of the final rinse pump 14 to the final rinse nozzles 15.1, 15.2.

As already stated, the wash nozzles 11.1, 11.2 and the final rinse nozzles 15.1, 15.2 can be arranged in the regions above and/or below and, if desired, also to the sides of the treatment zones 6, 7 in question within the treatment chamber 2 and each be directed toward the region in which the washware is positioned in the corresponding treatment zone.

Each treatment zone 6, 7 is preferably provided with a large number of wash nozzles 11.1 and 11.2 on at least one upper wash arm 10.1 and 10.3, a large number of wash nozzles 11.1 and 11.2 on a lower wash arm 10.2 and 10.4, a large number of final rinse nozzles 15.1 and 15.2 on at least one upper final rinse arm 18.1 and 18.3, and a large number of final rinse nozzles 15.1 and 15.2 on at least one lower final rinse arm 18.2 and 18.4. As already stated, the lower wash arm 10.2 of the upper main treatment zone 6 and the upper wash arm 10.3 of the lower additional treatment zone 7 can be designed as a common wash arm in this case (cf. FIG. 4). This also applies for the corresponding final rinse arms 18.2, 18.3.

However, as an alternative to this, it is equally feasible for each of the at least two treatment zones 6, 7 to be provided with separate wash and final rinse arms 10.1-10.4 and 18.1-18.4, as is indicated in the hydraulics diagram according to FIG. 5.

Before final rinse liquid is sprayed during the final rinse phase, a quantity of wash liquid which corresponds to the final rinse liquid is in each case pumped out of the wash tank 12 by means of a discharge pump (not illustrated in the drawings), the intake end of said discharge pump being connected to a sump of the wash tank 12 via a discharge line. If the wash tank 12 is empty before the dishwasher 1, which is designed as a batch dishwasher, is first started, said wash tank first has to be filled with fresh water via a fresh water line (not shown) or with fresh water or another final rinse liquid or wash liquid by means of the final rinse system and the final rinse pump 14 of said final rinse system.

The final rinse liquid may be fresh water or fresh water which is mixed with rinse aid. The wash liquid on the other hand contains detergent which is preferably automatically added in a metered manner to the liquid which is contained in the wash tank 12 by a detergent metering apparatus (not shown). The abovementioned program control device controls the wash pumps 13, the final rinse pump 14, the discharge pump and the detergent solution pump (not shown) depending on the cleaning program in each case selected on the program control device by an operator. At least one cleaning program is provided; a plurality of cleaning programs which can be selectively chosen are preferably provided.

It can be seen from the hydraulics diagrams illustrated in the drawings that a final rinse pump 14, by way of its intake end, is also connected to an outlet of a boiler 22. The boiler 22 further has an inlet which is connected to a fresh water supply line 30 via which fresh water or fresh water to which rinse aid has been added in a metered manner is supplied to the boiler 22. In the boiler 22, the liquid (pure fresh water or fresh water to which rinse aid has been added in a metered manner) which is supplied via the inlet is heated up as prescribed by a process sequence. The final rinse liquid which is heated up in the boiler 22 can be supplied to the final rinse nozzles 15.1 and 15.2 by means of the final rinse line system 17 for example during a fresh water final rinse phase by means of the final rinse pump 14 which, by way of its intake end, is connected to the boiler outlet. The final rinse nozzles 15.1 and 15.2 are arranged in the treatment zones 6, 7 of the treatment chamber 2 in order to spray the final rinse liquid, which is heated up in the boiler 22, onto the washware in the corresponding treatment zone 6, 7 of the treatment chamber 2. It goes without saying that it is also feasible for pure fresh water to be supplied to the boiler 22 via the inlet in the fresh water supply line 30, a rinse aid being added in a metered manner to said pure fresh water after it is heated in the boiler 22.

In this connection, it is also feasible for the final rinse system to have a preferably electrically operated steam generator which can be integrated into the boiler 22 for example. In this case, a corresponding steam outlet of the steam generator can be formed at the upper region of the boiler 22 (not illustrated in the drawings). The steam outlet of the steam generator can be connected to the treatment chamber via a steam line at a point which is situated above the wash tank, in order to introduce the steam which is generated in the steam generator into said treatment chamber as required. It goes without saying, however, that other positions are also possible.

A heater 47 is located in the boiler 22 which, according to some embodiments of the invention, serves not only to heat the final rinse liquid but also to generate steam if required. A level sensor which controls, for example, a valve 49 of the fresh water line 30 can also be arranged in or on the boiler 22.

It can also be seen with reference to the hydraulics diagram illustrated in FIG. 6 that a dedicated wash system and a dedicated final rinse system can also be associated with each individual treatment zone 6, 7. In contrast to the embodiments which are shown in FIGS. 4 and 5, a dedicated wash pump 13.1 and a dedicated wash liquid system 16.1 and also a dedicated final rinse pump 14.1 with a dedicated final rinse line system 17.1 are associated with the treatment zone 6 in this case. In the same way, a dedicated wash pump 13.2 and a dedicated wash liquid system 16.2 and also a dedicated final rinse pump 14.2 with a dedicated final rinse line system 17.2 are associated with the treatment zone 7. In this case, the wash pumps 13.1, 13.2 and the final rinse pumps 14.1, 14.2 can be actuated independently of one another by a control device, not shown, so that different treatment programs can be realized in the respective treatment zones independently of one another.

Specifically, the control device 100 which is schematically indicated in FIGS. 4 to 6 serves to actuate the corresponding components, which can be actuated, of the wash and/or final rinse system of the dishwasher 1. In particular, the control device 100 is designed to actuate the preferably common wash pump 13 of the wash system in such a way that the wash cycle of each treatment cycle in the first treatment zone 6 is interrupted, while the wash cycle of a single treatment cycle in the second treatment zone 7 is intermittent.

Furthermore, in the exemplary embodiments of the dishwasher 1 according to the invention which are illustrated in the drawings, the control device 100 is also designed to actuate the preferably common wash pump 13 in such a way that wash liquid is always sprayed at the same time in the first and in the second treatment zone 6, 7.

In respect of the final rinse system of the dishwasher 1, the control device 100 is designed to actuate the two final rinse pumps 14.1, 14.2 in such a way that, in the second treatment zone 7, a final rinse cycle always takes place simultaneously or at least so as to overlap with a final rinse cycle in the first treatment zone 6.

In this case, it is advantageous when the control device 100 is also designed to actuate the preferably common wash pump 13 in such a way that the duration of a wash cycle of a single treatment cycle in the second treatment zone 7 matches the total duration of the wash cycles of a large number of treatment cycles in the first treatment zone 6. In particular, it is feasible in this connection for the control device 100 to actuate the preferably common wash pump 13 in such a way that the duration of a wash cycle of a single treatment cycle in the second treatment zone 7 is an integer multiple of the duration of one wash cycle in the first treatment zone 6.

In principle, provision is made in the embodiments of the dishwasher 1 according to the invention which are illustrated in the drawings for the control device 100 to be designed to actuate the at least one wash system and/or the at least one final rinse system in such a way that a wash cycle in the second treatment zone 7 is interrupted automatically, preferably selectively automatically, when at least one of the following conditions is met:

- a final rinse cycle is taking place in the first treatment zone 6; and/or
- the first treatment zone 6 is open or is not closed, it being possible for this to be detected by means of a corresponding sensor for example; and/or
- the second treatment zone 7 is open or is not closed, it being possible for this to likewise be detected by means of a corresponding sensor for example.

The wash system and/or final rinse system are preferably automatically actuated. In other words, the at least one wash and/or final rinse system is preferably actuated in accordance with a predefined program sequence, wherein at least one predefined program sequence for the first treatment zone 6 and/or the at least one second treatment zone 7 is stored in the control device 100. A large number of predefined program sequences for the first treatment zone 6 and/or the at least one second treatment zone 7 are preferably stored in the control device 100.

In this connection, it is feasible for at least one program sequence group containing a defined program sequence for the first treatment zone 6 and a defined program sequence for the at least one second treatment zone 7 to be stored in the control device 100. In this case, a program sequence from the large number of predefined program sequences for the first treatment zone 6 and, independently of this, a program sequence from the large number of predefined program sequences for the at least one second treatment zone 7, or a predefined program sequence group, can be selectively chosen by the operator of the dishwasher 1.

At least one program sequence group containing a defined program sequence for the first treatment zone 6 and containing a defined program sequence for the at least one second treatment zone 7 is advantageously stored in the control device 100, and wherein the program sequences of the program sequence group are chosen depending on at least one of the factors listed below:

- a quantity of washware which preferably accumulates per unit time in a standard situation; and/or
- the different types of washware which preferably accumulate per unit time in a standard situation; and/or
- a degree of soiling of the washware which preferably occurs in a standard situation.

It is also preferred for at least one program sequence group containing a defined program sequence for the first treatment zone 6 and a defined program sequence for the at least one second treatment zone 7 to be stored in the control device 100, wherein the program sequence group has a program sequence for the first treatment zone 6, the duration of a wash cycle of the first treatment zone being 40 to 70 seconds, 70 to 120 seconds or 2 to 5 minutes in accordance with said program sequence, and wherein the program sequence group has a program sequence for the at least one second treatment zone 7, the duration of a wash cycle in the second treatment zone 7 being identical to the duration of a wash cycle in the first treatment zone 6 in accordance with said program sequence.

Secondly, it is preferred for at least one program sequence group containing a defined program sequence for the first treatment zone 6 and a defined program sequence for the at least one second treatment zone 7 to be stored in the control device 100, wherein the program sequence group has a program sequence for the first treatment zone 6, the duration of a wash cycle in the first treatment zone being 40 to 70 seconds, 70 to 120 seconds or 2 to 5 minutes in accordance with said program sequence, and wherein the program sequence group has a program sequence for the at least one second treatment zone 7, the duration of a wash cycle in the second treatment zone being 40 to 70 seconds, 70 to 120 seconds or 4 to 10 minutes in accordance with said program sequence.

An exemplary embodiment of a user interface 110 is described below with reference to the illustration in FIG. 7, it being possible for an operator of the dishwasher 1 according to the invention to choose at least one treatment program or corresponding treatment parameters for the first and/or second treatment zone 6, 7 via said user interface.

Figure 7:
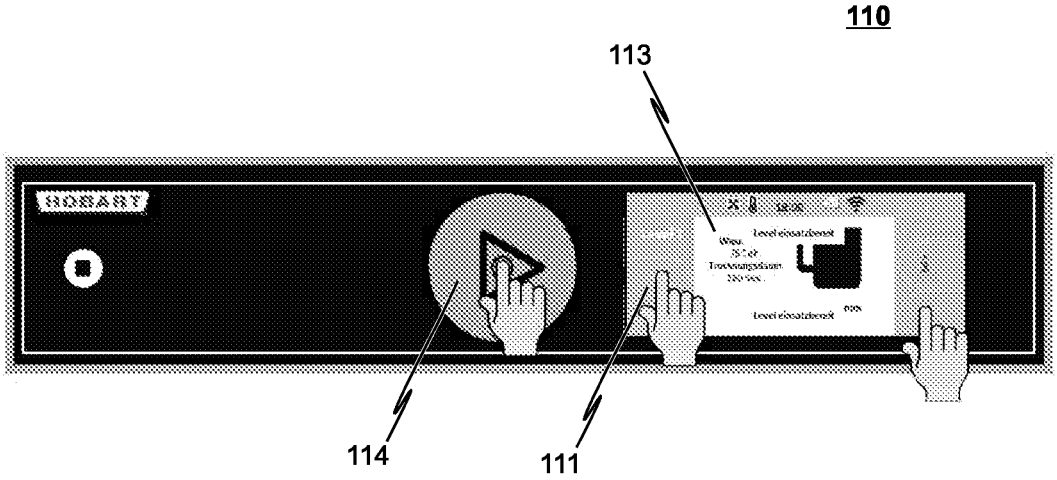
FIG. 7 shows an embodiment of a user interface for the dishwasher according to the invention.

Specifically, the embodiment of the user interface 110 which is illustrated in FIG. 7 is realized as a common user interface for both treatment zones 6, 7 of the dishwasher 1.

As can be seen from the illustrations in FIGS. 1 to 4, this common user interface 110 is arranged in the upper region of the movable hood 8.

It goes without saying that the present invention is not restricted to embodiments in which a common user interface 110 is used for all of the treatment zones 6, 7 of the dishwasher 1. In particular, it is feasible for a user interface to be provided in each case for the first and at least one second treatment zones 6, 7. In this case, it would be possible to arrange the user interface 110 for the first treatment zone 6 in the upper region of the hood 8, and to arrange the user interface 110 for the at least one second treatment zone 7 above the door 9 which is realized separately from the hood 8.

As indicated in FIG. 7, the user interface 110 is designed to provide information relating to a system state of the dishwasher 1. In the illustration in FIG. 7, this is performed in an optical manner by means of a corresponding information area 113.

Furthermore, the user interface 110 is provided with an input area 111 in order to allow the operator to manually intervene in a treatment cycle of the first treatment zone 6 and/or in a treatment cycle of the at least one second treatment zone 7.

In particular, the user interface 110 which is schematically illustrated in FIG. 7 is provided with a first input area 114, which can be manually operated, in order to start and, respectively, complete a treatment cycle in the first and/or at least one second treatment zone 7, and with a second input area 111, which is realized separately from the first input area 114, in order to retrieve information relating to a system state of the dishwasher 1 and/or in order to intervene in a treatment cycle of the first and/or at least one second treatment zone 7, and/or in order to call up and/or choose program parameters for the first and/or at least one second treatment zone 7.

Accordingly, in summary, it is clear that the solution according to the invention provides at least one additional treatment zone 7, specifically in particular for washware, such as cutlery or GN containers, which is generally heavily soiled and therefore requires a longer dishwashing duration. In this way, the wash performance can be improved by extending the program duration of the additional treatment zone 7, specifically in such a way, as is necessary for the type of washware which is to be treated in this treatment zone 7, that a satisfactory dishwashing result is ensured. In addition to this, the capacity of the main wash zone 6 is not negatively influenced, that is to say not reduced, despite the use of the intensive program in the additional treatment zone 7.

By way of example, five racks can be treated by the main treatment zone 6 using a standard treatment program, while one rack can additionally be treated at the same time, that is to say in parallel, in the lower or additional treatment zone 7 using an intensive treatment program.

Therefore, the previously existing treatment zone 6 can be operated without a loss of capacity for the washware with a normal level of soiling in comparison to current machines, specifically with simultaneous improvement in the wash result for heavily soiled washware, since said heavily soiled washware can be cleaned in parallel in the additional treatment zone 7, for example using a special intensive treatment program.

The invention is not restricted to the exemplary embodiments which are illustrated purely by way of example in the drawings, but rather can be gathered by looking at all of the features and aspects disclosed in said exemplary embodiments together.

The invention claimed is:

1. A hood-type batch dishwasher comprising:

a treatment chamber with at least one wash system which is configured as a recirculation system, wherein the treatment chamber is divided into at least a first treatment zone and a second treatment zone, wherein the first treatment zone and the second treatment zone are arranged one above the other, and wherein the first treatment zone and the second treatment zone are configured such that items of washware are treatable independently of one another and at least temporarily at the same time in the first treatment zone and in the second treatment zone;

wherein a final rinse system with at least one final rinse pump and with a final rinse nozzle system which is arranged in the treatment chamber is also provided in order to spray final rinse liquid, comprising fresh water, in the treatment chamber for final rinsing of items of washware; and a control device configured for actuating the at least one wash system and the final rinse system;

wherein the final rinse system has a first final rinse pump for supplying final rinse liquid to a plurality of first final rinse nozzles that spray into the first treatment zone and a second final rinse pump for independently supplying final rinse liquid to a plurality of second final rinse nozzles that spray into the second treatment zone, wherein the second final rinse nozzles are separate from the first final rinse nozzles so that final rinse spraying within the first treatment zone can take place independently of final rinse spraying within the second treatment zone;

wherein the control device is configured to carry out respective treatment cycles in the first treatment zone and the second treatment zone, which includes actuating the final rinse system in such a way that:

in the second treatment zone, a final rinse cycle of each treatment cycle always overlaps with a final rinse cycle of a treatment cycle in the first treatment zone; and in the first treatment zone, at least one final rinse cycle of at least one other treatment cycle does not overlap with any final rinse cycle in the second treatment zone.

2. The hood-type batch dishwasher as claimed in claim 1, wherein the first treatment zone can be closed by means of a hood which can be pivoted or moved vertically, and the second treatment zone can be closed by means of a door which is realized separately from the hood.

3. The hood-type batch dishwasher as claimed in claim 2, wherein the first treatment zone has a first loading volume which can be effectively used for cleaning washware, and the second treatment zone has a second loading volume which can be effectively used for cleaning washware, wherein the first loading volume is selected to be 2 to 4 times greater than the second loading volume, wherein the first loading volume is between 60 and 180 Liters, and wherein the second loading volume is between 25 and 75 Liters; and/or wherein the base area of the first treatment zone has dimensions which match a dish rack base area of 600 mm×500 mm, 500 mm×500 mm or 400 mm×400 mm; and/or wherein the hood is realized such that it can be pivoted or moved vertically upward by at least 300 mm; and/or wherein the first treatment zone has a height, which is effective for cleaning washware, of at least 400 mm; and/or wherein the second treatment zone has a height, which is effective for cleaning washware, of at least 120 mm; and/or wherein the hood-type batch dishwasher has, in the closed state of the treatment zones, a width of between 500 mm and 800 mm, a depth of between 700 mm and 900 mm, and a height of between 1350 mm and 1600 mm; and/or wherein the first treatment zone is configured to accommodate a dish rack the washware which is to be treated in the first treatment zone, in such a way that the lower region of the dish rack, which lower region supports the dish rack, lies at a predefined or predefinable horizontal wash level, wherein the height of the horizontal wash level of the first treatment zone can be variably adjusted, and is 800 mm to 900 mm; and/or wherein the hood-type batch dishwasher is equipped with an entry and/or exit table at its entry and/or exit end, and wherein the table level of the entry and/or exit table is aligned with the horizontal wash level of the first treatment zone.

4. The hood-type batch dishwasher as claimed in claim 2, wherein the door which is realized separately from the hood can be pivoted about a horizontal pivot axis and is realized in such a way that the door, when the door is in an open state, is horizontally aligned with the horizontal wash level of the at least one second treatment zone, wherein the height of the horizontal wash level of the at least one second treatment zone can be variably adjusted, and is 350 mm to 600 mm.

5. The hood-type batch dishwasher as claimed in claim 1, wherein the at least one wash system has a nozzle system with at least one wash nozzle for spraying wash liquid onto the washware.

6. The hood-type batch dishwasher as claimed in claim 5, wherein the nozzle system has at least one first wash arm which is associated with the first treatment zone, and has at least one second wash arm which is associated with the second treatment zone; and/or wherein the nozzle system has a common wash arm which is associated with the first and the second treatment zone jointly; and/or wherein the hood-type batch dishwasher has a wash tank for collecting at least some of the wash liquid which is sprayed by the nozzle system in the first treatment zone and the second treatment zone of the treatment chamber; and/or wherein the nozzle system has a common wash arm which is associated with the first treatment zone and the second treatment zone jointly, and wherein the at least one wash system is realized as a wash system which is common to the first treatment zone and the second treatment zone, and has a common wash pump for supplying wash liquid, which is collected in the wash tank, to the nozzle system.

7. The hood-type batch dishwasher as claimed in claim 1, wherein the control device is configured to actuate the at least one wash system in such a way that the wash cycle of each treatment cycle in the first treatment zone is uninterrupted, while the wash cycle of a single treatment cycle in the second treatment zone is intermittent.

8. The hood-type batch dishwasher as claimed in claim 7, wherein the control device is also configured to actuate the at least one wash system in such a way that wash liquid is always sprayed at the same time in the first treatment zone and the second treatment zone; and/or wherein the control device is also configured to actuate the at least one wash system in such a way that the duration of a wash cycle of a single treatment cycle in the second treatment zone matches the total duration of the wash cycles of a plurality of treatment cycles in the first treatment zone; and/or wherein the control device is also configured to actuate the at least one wash system in such a way that the duration of a wash cycle of a single treatment cycle in the second treatment zone is an integer multiple of the duration of one wash cycle in the first treatment zone; and/or wherein the control device is also configured to actuate the at least one wash system and/or the at least one final rinse system in such a way that a wash cycle in the second treatment zone is interrupted automatically, when any one of the following conditions is met:

a final rinse cycle is taking place in the first treatment zone; or the first treatment zone is open or is not closed; or the second treatment zone is open or is not closed;

and/or wherein the control device is also configured to actuate the at least one wash system in such a way that:

the temperature of the wash liquid which is sprayed in the first treatment zone is different from the temperature of the wash liquid which is sprayed in the second treatment zone; and/or the nozzle pressure of the wash liquid which is sprayed in the first treatment zone is different from the nozzle pressure of the wash liquid which is sprayed in the second treatment zone; and/or the quantity of wash liquid which is sprayed in the first treatment zone per unit time is different from the quantity of wash liquid which is sprayed in the second treatment zone per unit time; and/or the concentration of detergent in the wash liquid which is sprayed in the first treatment zone is different from the concentration of detergent in the wash liquid which is sprayed in the second treatment zone;

and/or wherein the control device is also configured to actuate the final rinse system in such a way that:

the temperature of the final rinse liquid which is sprayed in the first treatment zone is different from the temperature of the final rinse liquid which is sprayed in the second treatment zone; and/or the nozzle pressure of the final rinse liquid which is sprayed in the first treatment zone is different from the nozzle pressure of the final rinse liquid which is sprayed in the second treatment zone; and/or the quantity of final rinse liquid which is sprayed in the first treatment zone per unit time is different from the quantity of final rinse liquid which is sprayed in the second treatment zone per unit time; and/or the concentration of final rinse aid in the final rinse liquid which is sprayed in the first treatment zone is different from the concentration of final rinse aid in the final rinse liquid which is sprayed in the second treatment zone.

9. The hood-type batch dishwasher as claimed in claim 1, wherein at least one predefined program sequence for the first treatment zone and the second treatment zone is stored in the control device.

10. The hood-type batch dishwasher as claimed in claim 1, wherein a plurality of predefined program sequences for the first treatment zone and the second treatment zone are stored in the control device, wherein at least one program sequence group containing both a defined program sequence for the first treatment zone and a defined program sequence for the second treatment zone is stored in the control device.

11. The hood-type batch dishwasher as claimed in claim 9, further comprising at least one user interface with at least one input area, which can be manually or optically operated, for manually choosing at least one treatment program for the first treatment zone and the second treatment zone.

12. The hood-type batch dishwasher as claimed in claim 11 wherein a common user interface is provided for the first treatment zone and the second treatment zone, wherein the first treatment zone can be closed by means of a hood which can be pivoted or moved vertically, and wherein the common user interface is arranged in the upper region of the hood; or wherein the first treatment zone can be closed by means of a hood which can be pivoted or moved vertically, and the second treatment zone can be closed by means of a door which is realized separately from the hood, and wherein a user interface for the first treatment zone is arranged in the upper region of the hood, and a user interface for the second treatment zone is arranged above the door.

13. The hood-type batch dishwasher as claimed in claim 11, wherein the at least one user interface is configured to provide, optically and/or acoustically, information relating to a system state of the hood-type batch dishwasher; and/or wherein the at least one user interface has at least one input keypad, which can be optically or manually operated, for manually intervening in a treatment cycle of the first treatment zone and/or in a treatment cycle of the second treatment zone; and/or wherein the at least one user interface has at least one progress indicator, in the form of a progress bar, for optically representing the progress of a treatment cycle in the first treatment zone and/or the second treatment zone; and/or wherein a progress indicator, in the form of a progress bar, is in each case provided for the first treatment zone and the second treatment zone; and/or wherein the at least one user interface has a first input button, which can be manually operated, for starting and/or completing a treatment cycle in the first treatment zone and/or the second treatment zone, and has a second input keypad, which can be manually or optically operated and is realized separately from the first input keypad, for retrieving information relating to a system state of the hood-type batch dishwasher and/or for manually intervening in a treatment cycle of the first treatment zone and/or the second treatment zone and/or for calling up and/or choosing program parameters for the first treatment zone and/or the second treatment zone.

14. A hood-type batch dishwasher, comprising:

a treatment chamber with at least one wash system which is configured as a recirculation system, wherein the treatment chamber is divided into a first treatment zone and a second treatment zone, wherein the first treatment zone and the second treatment zone are arranged one above the other, and wherein the first treatment zone and the second treatment zone are configured such that items of washware are treatable independently of one another and at least temporarily at the same time in the first treatment zone and in the second treatment zone;

a final rinse system configured for enabling final rinsing within the first treatment zone independently of final rinsing in the second treatment zone, the final rinse system including a first final rinse pump for supplying final rinse liquid to a plurality of first final rinse nozzles that spray into the first treatment zone, and a second final rinse pump for independently supplying final rinse liquid to a plurality of second final rinse nozzles that spray into the second treatment zone, wherein the second final rinse nozzles are separate from the first final rinse nozzles so that final rinse spraying within the first treatment zone can take place independently of final rinse spraying within the second treatment zone;

a control device configured for actuating the at least one wash system and the final rinse system, wherein the control device includes at least one stored cleaning program by which the control device is configured to carry out overlapping treatment cycles in the first treatment zone and the second treatment zone, which includes actuating the final rinse system in such a way that:

in the second treatment zone, a final rinse cycle step of each treatment cycle always overlaps with a final rinse cycle step of a treatment cycle in the first treatment zone; and in the first treatment zone, a final rinse cycle step of at least one other treatment cycle does not overlap with any final rinse cycle step in the second treatment zone.

15. The hood-type batch dishwasher as claimed in claim 14, wherein the first treatment zone includes a hood which is vertically movable between a position to access the first treatment zone through a first opening to the first treatment zone and a position to close the first opening, and wherein the second treatment zone includes a door that is separate from the hood and is pivotally moveable between a position to access the second treatment zone through a second opening to the second treatment zone and a position to close the second opening.

16. The hood-type batch dishwasher as claimed in claim 15, wherein pivotal movement of the door is independent of vertical movement of the hood.

17. The hood-type batch dishwasher as claimed in claim 15 wherein the first final rinse pump is connected to deliver final rinse liquid from a boiler to the first final rinse nozzles, and the second final rinse pump is connected to deliver final rinse liquid from the boiler to the second final rinse nozzles.

18. A hood-type batch dishwasher, comprising:

a treatment chamber with at least one wash system which is configured as a recirculation system, wherein the treatment chamber is divided into a first treatment zone and a second treatment zone, wherein the first treatment zone is above the second treatment zone, wherein the first treatment zone includes a hood which is vertically movable between a position to access the first treatment zone through a first opening to the first treatment zone and a position to close the first opening, and wherein the second treatment zone includes a door that is separate from the hood and is pivotally moveable between a position to access the second treatment zone through a second opening to the second treatment zone and a position to close the second opening;

a final rinse system configured for enabling final rinsing within the first treatment zone independently of final rinsing in the second treatment zone, the final rinse system including a first final rinse pump for supplying final rinse liquid to a plurality of first final rinse nozzles that spray into the first treatment zone, and a second final rinse pump for independently supplying final rinse liquid to a plurality of second final rinse nozzles that spray into the second treatment zone, wherein the second final rinse nozzles are separate from the first final rinse nozzles so that final rinse spraying within the first treatment zone can take place independently of final rinse spraying within the second treatment zone;

a control device configured for actuating the at least one wash system and the final rinse system, wherein the control device includes at least one selectable cleaning program by which the controller is configured to carry out overlapping treatment cycles in the first treatment zone and the second treatment zone, where each treatment cycle includes a wash cycle step followed by a rinse cycle step, wherein the overlapping treatment cycles include actuating the at least one wash system and the final rinse system in such a way that:

a wash cycle step of a single treatment cycle in the second treatment zone overlaps with each wash cycle step of multiple treatment cycles in the first treatment zone but does not overlap with any final rinse cycle steps of the multiple treatment cycles in the first treatment zone;

in the second treatment zone, a final rinse cycle step of the single treatment cycle overlaps with the final rinse cycle step of a last one of the multiple treatment cycles in the first treatment zone; and in the first treatment zone, the final rinse cycle step of each treatment cycle preceding the last one of the multiple treatment cycles does not overlap with the final rinse cycle step of the single treatment cycle in the second treatment zone.

* * * * *